United States Patent [19]

Johnson

[11] 4,246,953

[45] Jan. 27, 1981

[54] ADJUSTABLE FILLER MEANS FOR MOLDS AND METHOD THEREOF

[76] Inventor: Lloyd M. Johnson, 16502 Marquardt Ave., Cerritos, Calif. 90701

[21] Appl. No.: 63,182

[22] Filed: Aug. 3, 1979

[51] Int. Cl.[3] ..... B22C 9/00

[52] U.S. Cl. ..... 164/7; 164/15; 164/374; 164/382

[58] Field of Search ..... 164/374, 377, 378, 379–396, 164/411, 6, 7, 15, 29, 37

[56] References Cited

U.S. PATENT DOCUMENTS

| | | | |
|---|---|---|---|
| 1,159,114 | 11/1915 | Smith | 164/382 |
| 1,948,867 | 2/1934 | Oyster | 164/382 |
| 2,460,218 | 1/1949 | Duncan | 164/382 |

FOREIGN PATENT DOCUMENTS

| | | | |
|---|---|---|---|
| 423563 | 9/1974 | U.S.S.R. | 164/379 |

*Primary Examiner*—Robert D. Baldwin
*Assistant Examiner*—K. Y. Lin
*Attorney, Agent, or Firm*—Francis X. LoJacono

[57] ABSTRACT

An adjustable filler means for molds and method thereof which comprises a molding flask adapted to adjustably receive and support a plurality of mold-contouring fingers arranged to be functionally held in spaced relation to a pattern within the flask, so as to be readily moved and adjusted to conform to any irregular contour of such pattern or core print disposed within the flask, and wherein a contour medium is provided between the fingers and the surface of the pattern to establish a contoured space between the fingers and pattern, whereby molding sand is provided therein to form the face of a mold or core.

13 Claims, 14 Drawing Figures

FIG. 1
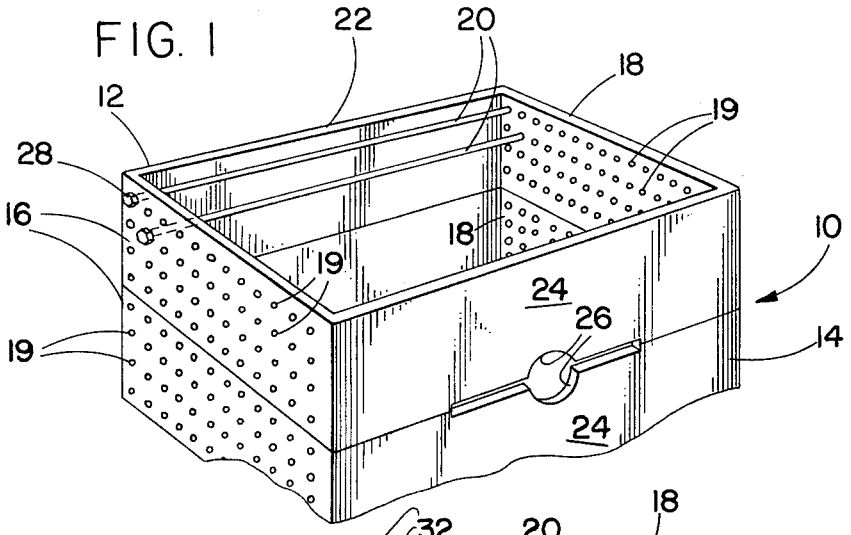
FIG. 2
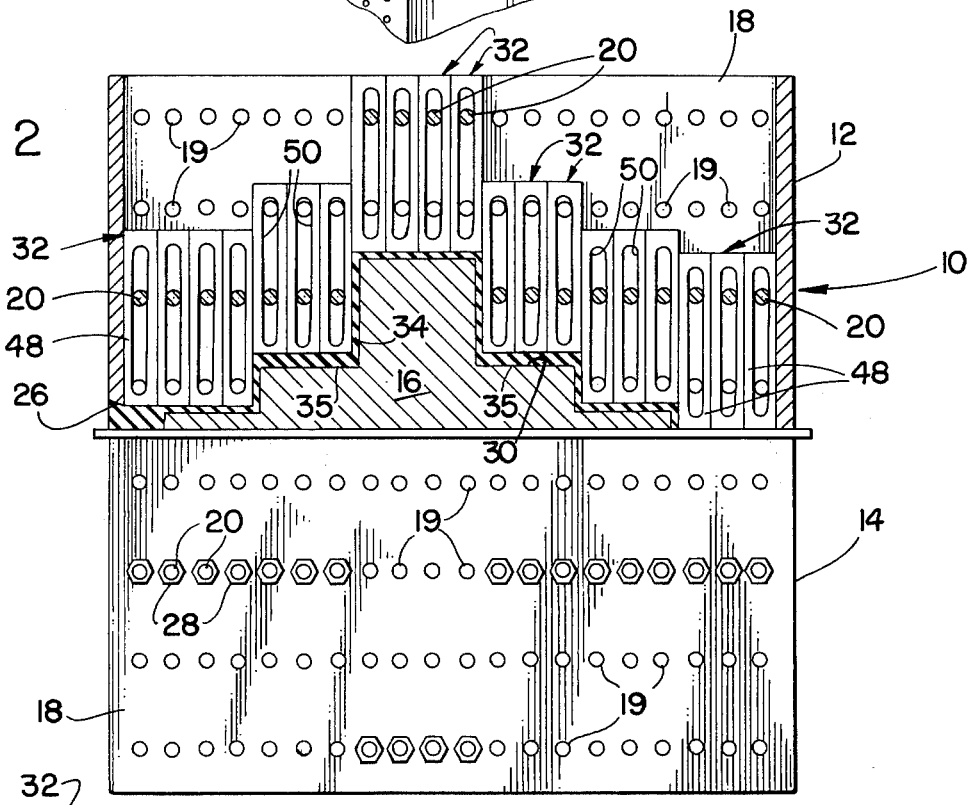
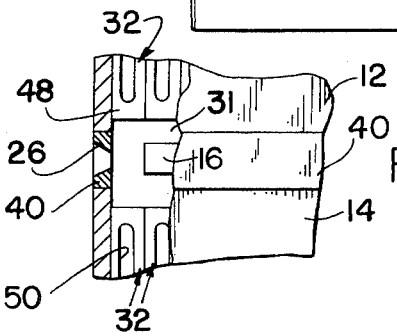
FIG. 14
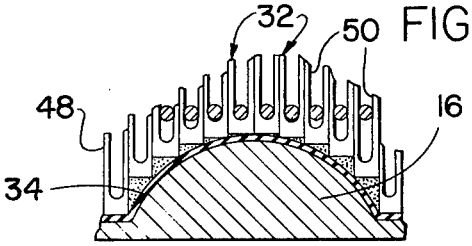
FIG. 3

ADJUSTABLE FILLER MEANS FOR MOLDS AND METHOD THEREOF

BACKGROUND OF THE INVENTION

1. Field of the Invention

This invention relates generally to flasks or jackets for mold-making—particularly of metal parts, and more particularly to such flasks or jackets having a plurality of fingers therein adjustable to the basic pattern contour, whereby a greater percentage of molding sand can be eliminated.

2. Description of the Prior Art

As is well known in the art, various problems and difficulties are encounted in providing suitable apparatuses for making molds for casting metal parts.

Many types of flask designs are used along with the various types and mixtures of sands and molding media to solve well-established problems, particularly those problems affecting the physical properties of casting members.

However, lack of proper chilling has been and is still a major problem found in the casting industry. This is very often due to the amounts of molding sand and its ability to dissipate heat from varied-shaped metal castings. Some areas of a casting cool faster than adjacent areas. Such uneven cooling has been a major problem which physically affects a molded part.

Another problem is the use of very large amounts of molding sand for each mold and the desire to recycle the sand for further application, after it has been used to make a mold. Thus, there is a need for a new and unique design of flasks and/or jackets that would provide and incorporate means for cooling a molded part to effect solidification as desired over its entire surface, as well as to reduce the amount of molding sand per flask.

Accordingly, there is a need for a molding device or a specially designed flask box that will allow and compensate for the various degrees of contours and thicknesses of a part or element being molded.

SUMMARY OF THE INVENTION

The present invention is provided with a unique means for establishing a variable-mold arrangement that is adapted to reduce the overall need for large amounts of molding sand or other molding media, and is further provided with a means for selectively cooling the mold in a shorter period of time.

Such a means comprises a plurality of adjustable finger members supported within a flask box by one embodiment comprising a plurality of rods which extend between two opposing side walls of the flask. The finger members are adjustable longitudinally along the rods as well as perpendicularly, allowing them to be adjusted and positioned to form the general surface outline of the pattern within the molding frame of the flask.

In addition to these fingers, there is further provided a contour medium, preferably of a soft pliable sheet material having a preselected thickness that is first positioned to cover the contoured surface of the pattern once the sheet is in place, the fingers being adjusted to engage the contour medium and to lock in place.

Accordingly, once the fingers are locked in position, the medium is removed therefrom, thereby establishing a contoured void which provides a controlled-space relationship between the pattern and the set fingers. The void is then filled with any suitable molding (or media) sand, generally known as "green sand". As will be understood from the following description, various methods will be readily suitable for inserting the molding media sand inside the flask compartment in order to fill the void to a uniform density. That is, the molding sand can be received through known types of sand gates, by injecting sand under pressure or by a vacuum process. This particular arrangement also allows the flask to be positioned horizontally or vertically while being filled with the molding sand, thereby allowing for a large variety of applications.

OBJECTS AND ADVANTAGES OF THE INVENTION

The present invention has for an important object a provision whereby a plurality of adjustable fingers are adapted to be positioned within the framework of molding flasks so as to conform to the general surface configuration of a pattern, and whereby the amount of molding sand or medium is greatly reduced in forming the mold or core configuration.

It is another object of the invention to provide a means for not only establishing the basic contour of a pattern, but to provide a unique means for chilling various sections of the mold member so as to cool them in a more rapid and selected manner, and to achieve optimum casting and physical properties of the finished molded part.

It is still another object of the invention to provide a molding device of this character wherein the fingers also include plyable or crushable material (such as rubber, polyurethane, etc.) attached to one or more sides thereof, so as to absorb the movement or shrinkage forces to the castable material.

It is a further object of the invention to provide a molding device wherein the flask or flask box can be rapidly cooled, so that the casting and medium may be dumped and the box used again on a fast-cycle run.

It is still a further object of the invention ro provide a device of this character that is adapted to include a contoured void or space arranged between the ends of the adjustable fingers and the pattern, by the use of a sheet of flexible material having a predetermined thickness or by providing a peripheral spacer positioned between each flask section after the fingers are selectively locked in place.

Another object of the invention is to provide a device of this character having a plurality of adjustable finger members of various configurations, so as to be adaptable to a particular casting arrangement, the fingers being provided with means therein for venting gases or for allowing a vacuum to be established with each flask.

A further object of the present invention is to provide a mold of this character that will save most of the amount of molding media that is used to make molds for casting, whereby smaller equipment could be employed to handle and process the molding media before and after the pouring of the castings, which in turn requires less floor space and energy.

Still a further object of the invention is to provide a device of this character that is rugged in construction, and that is easy to service and maintain.

The characteristics and advantages of the invention are further sufficiently referred to in connection with the accompanying drawings, which represent various embodiments. After considering these examples, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a pictorial view of a molding flask having one section thereof partially illustrated;

FIG. 2 is a side-elevational view of the new molding flask, with the upper flask box in section to illustrate the positioned fingers relative to the surface of a pattern;

FIG. 3 is a diagrammatic showing of the relationship between the fingers of the flask and a varied shape of a pattern to be molded;

FIG. 14 is a partial view of adjoining flask sections separated by a spacer element.

DESCRIPTION OF THE PREFERRED EMBODIMENT

Figure 4:
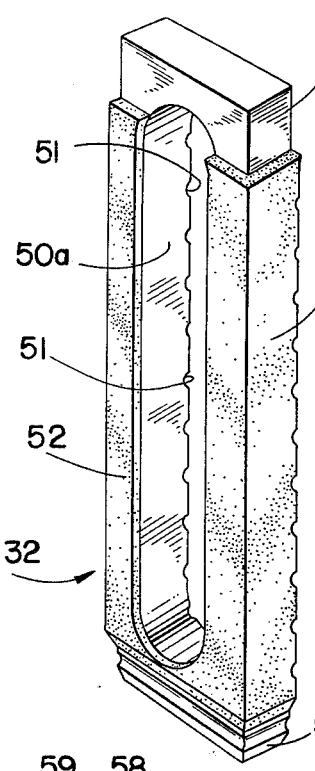
FIG. 4 is a perspective view of a finger member having crushable side members.

Referring more particularly to FIGS. 1 and 2, there is shown a molding flask, generally indicated at 10, including a first flask or box section 12 and a second flask or box section 14, which together provide a box-like housing in which a pattern 16 is generally positioned to further provide a specific mold cavity for the reproduction of any molded element or casting which will hereinafter be referred to as a workpiece.

Since it is well known in the art how castings are made, a detailed description is not herewith included. However, it is well established that a mold cavity to form a workpiece is provided by the use of molding sand of various compositions to form a bonded sand or media of uniform density. As an example, one such molding sand is known as "green sand" which is positioned in the flask-box sections and squeezed against the pattern, whereby a formed cavity for the intended workpiece is created. When this cavity is filled with molten metal and cooled, the result will be a casting with the desired size, shape, thickness and surface pattern ornamentation.

As can be seen in FIG. 1, each box section 12 and 14 comprises a generally rectangular configuration, with two opposing end walls 16 and 18 being provided with a plurality of juxtaposed holes 19 which are themselves aligned between each wall member, whereby rods 20 are arranged to be received therein and longitudinally positioned between walls 16 and 18. The other two opposed walls 22 and 24 complete the box sections. It should be noted that notches and slots 26 are provided in matching walls 24 of each box section. These slots and/or notches can be of any suitable arrangement or size so as to accommodate a sprue (not shown), the sprue being a hole through which metal is poured into a gate and thence into a mold cavity.

Each rod 20 is separately positioned within each box, the rods being provided with threaded ends having nuts 28 secured thereto—thus providing means for securing the rods in a predetermined location, depending upon the configuration of the pattern to be employed.

As an example, we refer to FIG. 2, in which there is shown a pattern 16 disposed within the confines of the two sections 12 and 14, the pattern having a face configuration at 30 which is to be outlined in the form of a molded cavity. Thus, in order to provide a molded cavity, there is further included therein a plurality of adjustable mold fingers 32. Mold fingers 32 are adapted to be movably supported on rods 20 in a juxtaposed contiguous arrangement, whereby a given area or space is occupied within the boxes 12 and 14, the space being normally adapted to receive and hold molding sand. However, fingers 32 can be positioned longitudinally and perpendicularly to the rods 20. Hence, it can be seen that by adjusting various fingers a general outline of the pattern 16 or any other configuration of a pattern may be established (see FIG. 3). When a general outline of the pattern face configuration is arranged, the fingers then are secured tightly into position. It is contemplated that various finger securing means can be provided. In FIGS. 1 and 2, the simple tightening of nuts 28 would be sufficient when the fingers 32 are fully within the four walls 16, 18, 22 and 24. Another finger securing means will hereinafter be described.

Since it is necessary to include a molding-sand material—generally known as facing sand—so as to provide a means to accurately define the configuration of pattern 16, there is further included a flexible mold material or medium 34 which is interposed between the contacting ends of fingers 32 and the surface of the pattern 16.

Figure 10:
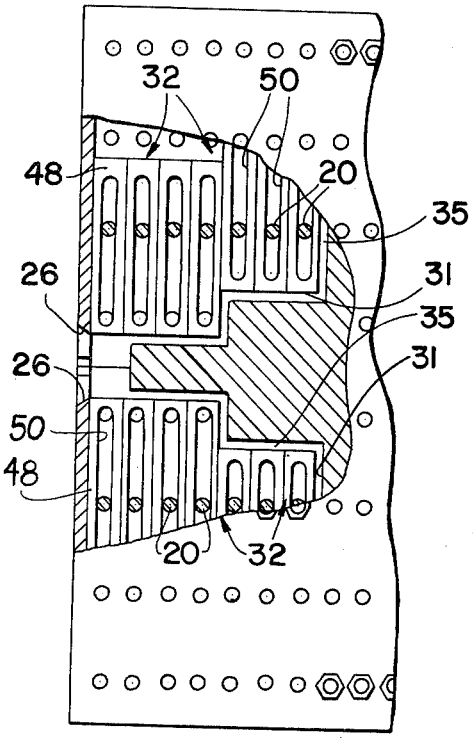
FIG. 10 is a partial view of a mold flask with a portion broken away, illustrating the void disposed between the fingers and the surface of the pattern just prior to receiving the molding sand therein.

Prior to the setting of the fingers, pattern 16 is covered by medium 34, as seen in FIG. 2. It is contemplated that this medium serve two purposes—one being a means to provide a defined space 31 between fingers 32 and pattern surface 30 wherein facing sand 35 is inserted therein in a firm compact manner, as seen in FIG. 10. It will also be later understood that various methods of inserting the facing sand or media can be employed.

The other purpose provided by the interposed medium 34 to establish an exact and predetermined separation between selected fingers and corresponding areas of the pattern. The medium, as FIG. 2 illustrates, includes an additional thickened wall section as at 35. The thickened areas will allow for thicker areas of facing sand to be interposed therebetween. Thus, when a metal casting is poured and is cooling, the areas having less sand displaced between the hot cooling metal and the fingers will tend to cool faster than the areas of metal adjacent the thickened sand areas. Hence, heat can be more readily transferred to the fingers which are positioned relatively closer to the hot metal than those having greater amounts of sand disposed therebetween. Accordingly, the cooling of a casting can be controlled in this manner whereby the casting will harden at a more selected rate, thereby preventing shrinking and physical damage to the resultant workpiece.

A second method of providing a defined space 31 to receive the facing sand 35 is illustrated in FIG. 14 wherein no medium material is required and the fingers are adjusted directly with the surface of pattern 16. After the fingers 32 are adjusted and locked into position, each box 12 and 14 is separated and a spacer insert 40 is positioned between each box, the amount or area of space 31 being determined by the width of spacer insert 40, which in turn determines the quantity of facing sand that must be used between the fingers and the pattern.

Figure 11:
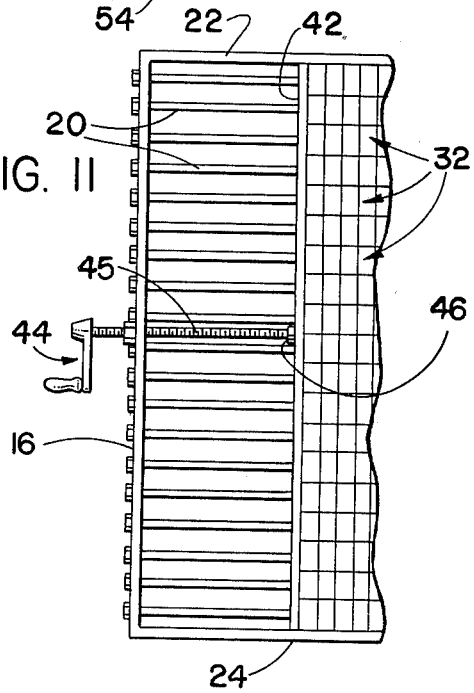
FIG. 11 is a partial top-plan view of a flask having an inner adjustable wall, providing a clamping means for holding the fingers in a selected position within the walls of the flask.

Now that we have established the basic arrangement of the apparatus, a second finger-securing means is shown in FIG. 11, wherein a laterally movable partition 42 is positioned within each box section, whereby a crank member 44 is mounted to one end wall 16 or 18 by a threaded crank shaft 45, which is journalled at 46 to partition 42. Thus, partition 42 can be forced against fingers 32, holding them in place.

It should be further understood that a similar crank means and partition can be provided at the opposite side wall, thereby allowing fingers 32 to be clamped between opposing partitions.

Various arrangements and designs of fingers 32 are contemplated, there being illustrated in FIGS. 2, 3, 4 and 10 a basic finger configuration comprising an elongated rectangular stock or bar 48, formed preferably of metal, having a longitudinal slot 50 to receive rod 20 therethrough and to allow for lateral adjustment of the finger along the length of the slot.

Figure 8:
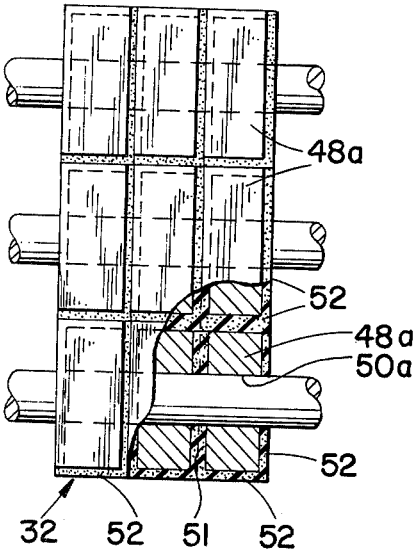
FIG. 8 is a top-plan view of a plurality of finger members, similar to the one illustrated in FIGS. 4 and 5.
Figure 9:
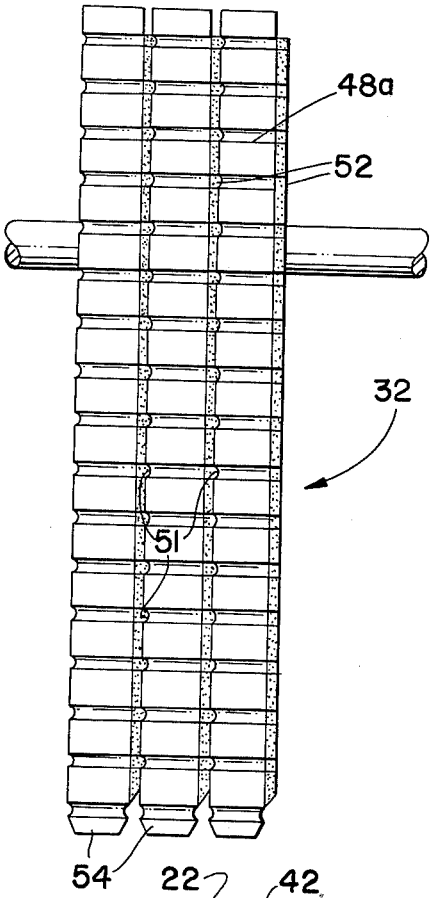
FIG. 9 is a side-elevational view of the fingers as shown in FIG. 8.

Referring now to the fingers as shown in FIGS. 4, 5, 8 and 9, there is illustrated a bar **48*a* having a longitudinal slot 50*a* similar to bar 48. Bar 48*a*, however, further includes a plurality of grooves 59 disposed transversely to the sides of the bar, at least one or more—but preferably two—sides being provided with a cover 52 of resilient material. The resilient material can be formed from any suitable material that can withstand high temperatures generated by the molten metal when poured into the mold cavity. Bars 48*a* are additionally provided with contact footings 54 which include grooves 56 to permit gas to flow out of the molds, if necessary, or to allow a vacuum to be formed within the flask housings. Further, footings 54 are employed to support the mold sand or media within the cavity. FIGS. 8 and 9 illustrate how bars 48*a* are abutted together, and how the contacting faces of covers 52 are forced into the grooves 51, thereby providing a means for locking each bar into its respective position relative to the pattern configuration. The resilient material of cover 52** also provides a means by which the bar can yield during shrinkage contraction of the metal after pouring.

Figure 6:
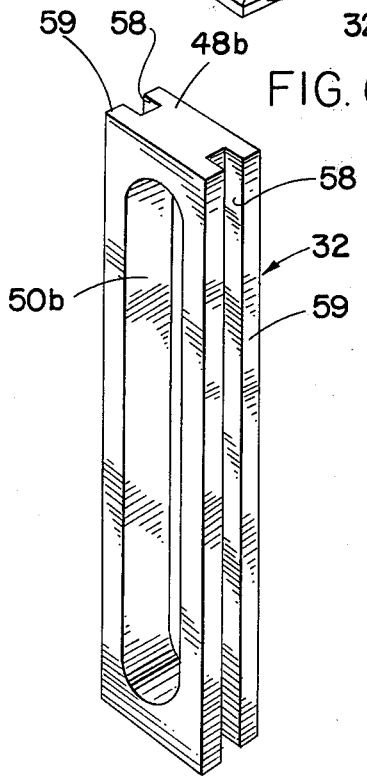
FIG. 6 is a perspective view of an alternative arrangement of a finger member having elongated side channels formed therein.
Figure 7:
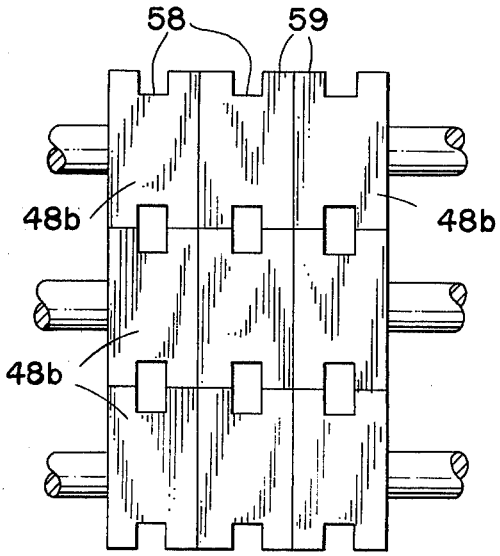
FIG. 7 is a top-plan view of a plurality of finger members of the type shown in FIG. 6, whereby opposing channel members are joined to form vent or filling passages.

Another embodiment of the basic finger 32 is shown in FIGS. 6 and 7 wherein finger 32 comprises a bar **48*b* having a slot 50*b* with oppositely disposed channels 58 formed longitudinally along the edges 59 of bar 48*b*. When bars 48*b* are positioned as seen in FIG. 7, matching adjacent channels 58** define passages that communicate between the inner cavity of the mold and the upper portion of the mold box. Such passages will be provided where there is a need to create a vacuum within the mold cavity to evacuate air or other gases from the cavity; and these passages will also allow molding sand to be inserted therethrough under pressure or a vacuum , if necessary. Such passages will also aid in allowing for rapid cooling, and setting.

Figure 12:
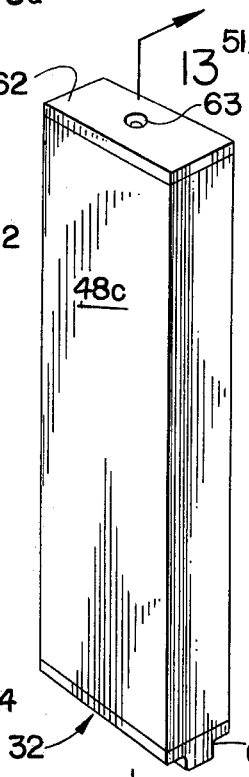
FIG. 12 is a perspective view of an alternative arrangement of a finger member having removable end members.
Figure 5:
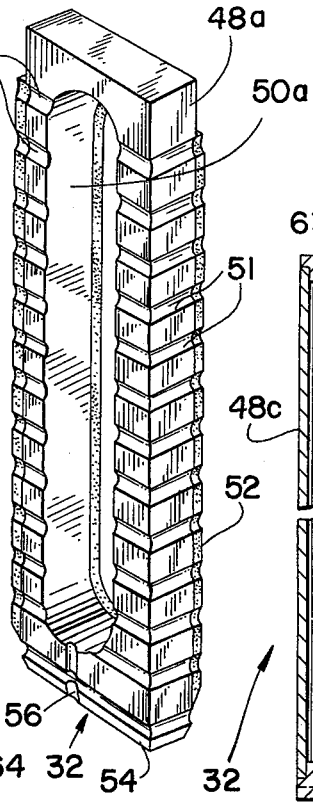
FIG. 5 is a perspective view of the finger in FIG. 4, illustrating the opposite side to show the grooved surface thereof.
Figure 13:
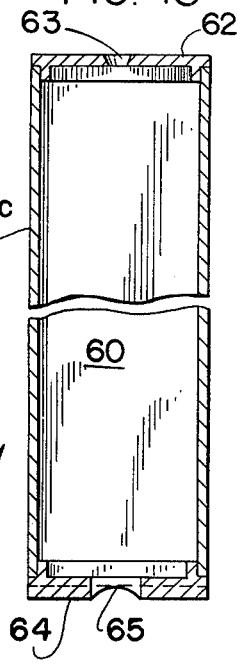
FIG. 13 is a cross-sectional view thereof taken along line 13—13 of FIG. 12.

A third embodiment is illustrated in FIGS. 12 and 13 wherein finger 32 comprises a generally tubular rectangular bar **48*c* having a chamber 60 defined therein and an upper end cap 62, including an aperture 63 and a bottom footing cap 64. Footing cap 64 is arranged to include an aperture 65 whereby air or gases from within the mold cavity can be evacuated, or whereby cap 62 can be removed to allow molding sand or other media to be inserted through aperture 65**.

It also should be noted that, when cap 62 is removed, a pin or rod can be passed through bar **48*c* and through aperture 65**, to eject the molding medium and casting.

However, the embodiment as shown in FIGS. 12 and 13 is not provided with an elongated slot; and, thus, this type of finger does not have the need for rods 20. Bars **48*c* are positioned in the same manner as indicated in FIG. 11, but without rods 20, wherein bars 48*c* are held in place only by the force of adjustable partitions, such as 42**.

Accordingly, it can be understood that various combinations of the disclosed embodiments of fingers 32 may be formed for use with or without the need for rods 20. Hence, the configuration of the fingers will be determined by their use in one of many casting methods such as in die-casting, permanent-mold casting, and sand-casting operations.

The invention and its attendant advantages will be understood from the foregoing description; and it will be apparent the various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. An adjustable filler means for molds, to establish the general contour of any given pattern to be cast, comprising:

a generally rectangular flask-molding box, having a first and second box section;

a plurality of finger members adapted to be adjustably positioned, both laterally and perpendicularly, within said flask molding box, whereby said fingers are held in a juxtaposed contiguous arrangement relative to the contour of said pattern;

means for adjustably positioning said fingers within said box and holding said fingers in selective positions; and means positioned between said fingers and said pattern to provide a predetermined spaced relationship between said fingers and said pattern, whereby a molding sand is adapted to be disposed therein to form a finished contoured mold cavity;

said means to provide a perdetermined spaced relationship between said fingers and said pattern comprises a resilient medium having a selective thickness disposed between said fingers and said pattern.

2. An adjustable filler means for molds, to establish the general contour of any given pattern to be cast, comprising:

a generally rectangular flask-molding box, having a first and second box section;

a plurality of finger members adapted to be adjustably positioned, both laterally and perpendicularly, within said flask molding box, whereby said fingers are held in a juxtaposed contiguous arrangement relative to the contour of said pattern;

means for adjustably positioning said fingers within said box and holding said fingers in selective positions; and means positioned between said fingers and said pattern to provide a predetermined spaced relationship between said fingers and said pattern, whereby a molding sand is adapted to be disposed therein to form a finished contoured mold cavity;

said means to provide a predetermined spaced relationship between said fingers and said pattern comprises a spacer insert to be positioned between said first and second box sections of said flask-molding box.

3. An adjustable filler means for molds as recited in claim 1, wherein said positioning-and-holding means comprises:

at least one movable partition positioned for longitudinal movement within said flask-molding box sections; and means mounted between said box and said partition to forceably engage and clamp said fingers in place therein.

4. An adjustable filler means for molds as recited in claim 3, wherein said positioning-and-holding means includes a plurality of rod members longitudinally secured between a pair of opposing walls forming said flask-molding box sections, and wherein said finger members include an elongated slot therein to receive a selective rod therethrough, whereby said fingers are adjustable longitudinally along said rod and laterally thereto, thereby allowing each finger to be selectively positioned relative to the contour of said pattern.

5. An adjustable filler means for molds as recited in claim 4, wherein each of said fingers comprises:

an elongated, generally rectangular bar member;

a plurality of laterally disposed grooves formed on at least two sides of said bar; and a resilient cover member mounted to the sides of said bar opposite said grooves thereof, whereby said resilient cover member is interlocked in said grooves when brought into engagement with an adjacent finger member.

6. An adjustable filler means for molds as recited in claim 4, wherein each of said fingers comprises:

an elongated, generally ractangular bar member; and channels formed longitudinally along oppositely disposed edges of said bar member, whereby a passage is defined between contiguously arranged bar members to allow gases to pass from inside the mold cavity and to allow molding sand to be passed therethrough into said mold cavity.

7. An adjustable filler means for molds as recited in claim 3, wherein said fingers comprise:

an elongated, generally rectangular, tubular bar member having an upper opened end and a closed lower end provided with a hole therein, to allow gases to pass from inside the mold cavity and to allow molding sand to pass through said tubular bar and into said mold cavity.

8. An adjustable filler means for molds as recited in claim 7, wherein said tubular bar includes a removable cap member having a hole positioned therein.

9. A method of forming a molded workpiece, comprising the steps of:

providing a flask-molding box having a first and second box section, each box section including a plurality of adjustable finger members mounted therein;

positioning a pattern within said box sections;

covering said pattern with a resilient medium;

adjusting said fingers to conform substantially to the configuration of said pattern;

providing a void space between said fingers and said pattern by removing said resilient medium;

inserting molding media within said void space to form a molding face therein;

removing said pattern from said box sections, whereby a molding cavity is formed; and pouring a castable material within said molding cavity to form said workpiece.

10. A method as recited in claim 9, including providing a resilient medium having varied thickness along the pattern contour, whereby a void space with varied dimension between said fingers and said pattern is formed after removing said resilient medium and a mold wall with different thickness at various sections is formed after said inserting step.

11. A method of forming a molded workpiece, comprising the steps of:

providing a flask-molding box having a first and second box section, each box section including a plurality of adjustable finger members mounted therein;

positioning a pattern within said box sections;

adjusting said fingers to conform substantially to the configuration of said pattern;

providing a void space between said fingers and said pattern by positioning a peripheral insert spacer between said first and second box sections;

wherein providing a void space between said fingers and said pattern includes the step of positioning a peripheral insert spacer between said first and second box sections, after said fingers are adjusted to the contour of said pattern;

inserting molding media within said void space to form a molding face therein;

removing said pattern from said box sections, whereby a molding cavity is formed; and pouring a castable material within said molding cavity to form said workpiece.

12. A method as recited in claim 11, wherein the step of inserting said molding media within said void space includes the insertion of said media under pressure.

13. The method as recited in claim 11, wherein the step of inserting said molding media within said void space includes the insertion of said media under vacuum.

* * * * *